US006332244B1

(12) United States Patent
Camozzi

(10) Patent No.: US 6,332,244 B1
(45) Date of Patent: Dec. 25, 2001

(54) METHOD AND APPARATUS FOR DRAFTING AND CONDENSING A ROVING, PARTICULARLY AN A RING SPINNING FRAME

(75) Inventor: Attilio Camozzi, Palazzolo (IT)

(73) Assignee: Marzoli S.P.A., Brescia (IT)

( * ) Notice: Subject to any disclaimer, the term of this patent is extended or adjusted under 35 U.S.C. 154(b) by 0 days.

(21) Appl. No.: 09/716,458

(22) Filed: Nov. 21, 2000

(30) Foreign Application Priority Data

Nov. 26, 1999 (IT) ..... MI99A2479
Dec. 6, 1999 (IT) ..... MI99A2550

(51) Int. Cl.[7] ..... D01H 5/86
(52) U.S. Cl. ..... 19/246; 19/236; 19/150
(58) Field of Search ..... 19/150, 236–250, 19/252, 263, 286–288, 304–308; 57/264, 304, 315, 328, 333

(56) References Cited

U.S. PATENT DOCUMENTS 3,122,794 * 3/1964 Klein ..... 19/288
4,290,170 * 9/1981 Brookstein et al. ..... 19/244
4,901,517 * 2/1990 Fisher ..... 57/315
5,157,911 * 10/1992 Stahlecker et al. ..... 57/328
5,600,872 * 2/1997 Artzt et al. ..... 19/244
5,996,181 * 12/1999 Fuchs ..... 19/150
6,073,314 * 6/2000 Barauke ..... 19/246
6,082,089 * 7/2000 Stahlecker ..... 57/315
6,108,873 * 8/2000 Barauke ..... 19/236
6,131,382 * 10/2000 Dinkelmann et al. ..... 57/315
6,158,091 * 12/2000 Olbrich et al. ..... 19/263
6,170,126 * 1/2001 Stahlecker ..... 19/246
6,185,790 * 2/2001 Stahlecker ..... 19/246

FOREIGN PATENT DOCUMENTS 196 23 824 A1 10/1997 (DE) .
298 22 763 U1 4/1999 (DE) .
0 947 618 A2 10/1999 (EP) .

* cited by examiner

*Primary Examiner*—John J. Calvert
*Assistant Examiner*—Gary L. Welch
(74) *Attorney, Agent, or Firm*—Sughrue Mion, PLLC

(57) ABSTRACT

A device for drafting and condensing of a roving before its transformation into yarn comprises a drafting unit which confers a predetermined draft on the roving and a condensing unit by the effect of suction on the fibres of the roving through a movable filtering surface reduces its dimensions increasing the cohesion and strength even before it receives the twist from the spinning machine.

3 Claims, 13 Drawing Sheets

Fig.7
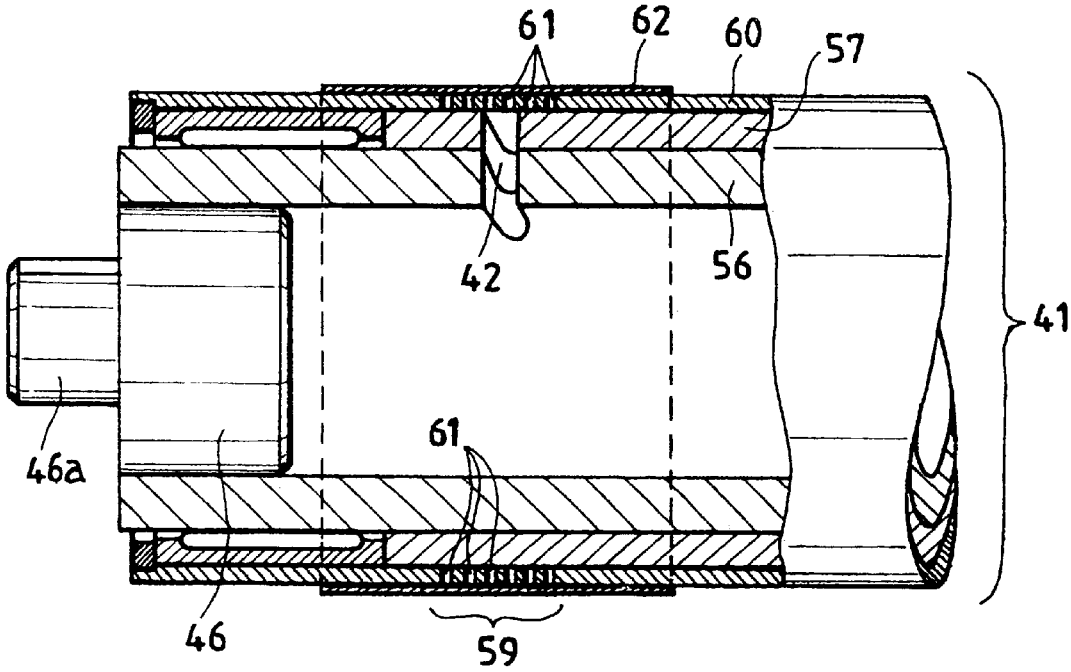
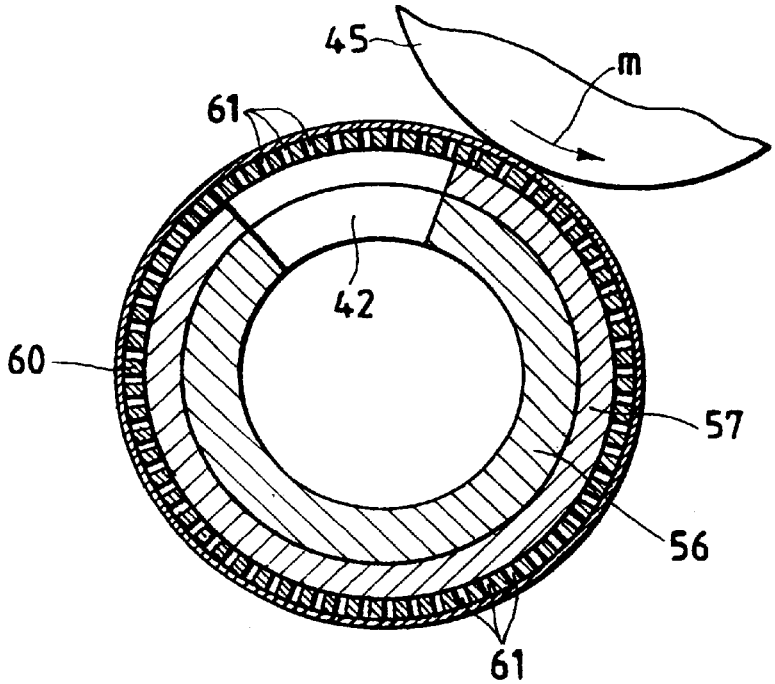
Fig.8

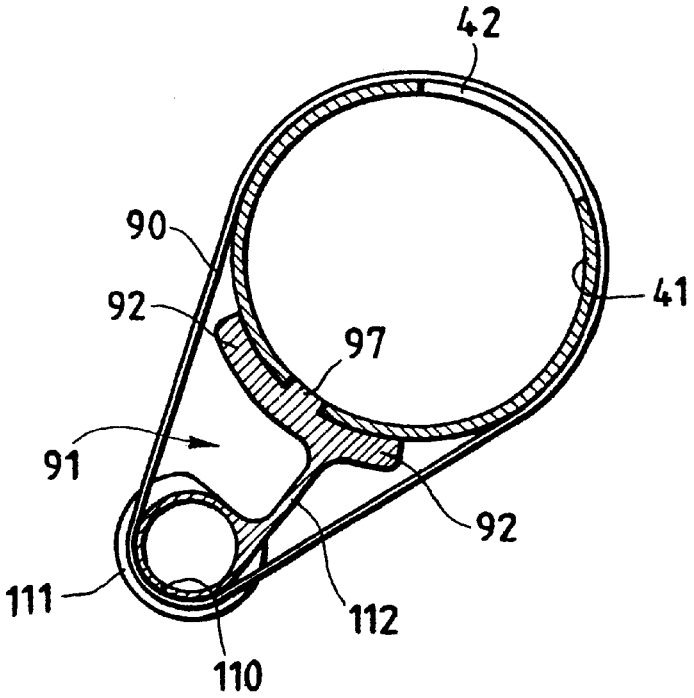
Fig.16
Fig.17
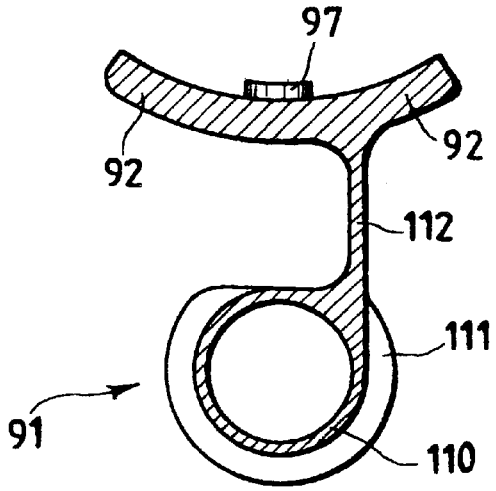

METHOD AND APPARATUS FOR DRAFTING AND CONDENSING A ROVING, PARTICULARLY AN A RING SPINNING FRAME

BACKGROUND OF THE INVENTION

The present invention relates to the drafting and condensing of a roving of textile fibre before its transformation into twisted yarn. Hereinafter it is described with reference to ring spinning although the invention can be utilised advantageously also in other applications of the textile industry.

Ring spinning is essentially the process in which a roving of textile fibres is transformed into a twisted yarn by first performing a drafting and controlled elongation of the roving by which it is given the desired dimensions, which determines the yarn count of the yarn produced from it, and then giving the bundle of fibres of the roving, which have received only a slight twist in the preceding working and are still substantially parallel, an effective and necessary twist to give the yarn an adequate strength by making it pass along a path in high speed rotation between a fixed ring and a rotating spindle with the interposition of a ring driven by the spindle itself. The yarn thus twisted is collected by winding it on a bobbin, carried by the spindle, to form a spool which, when completed, is transferred for subsequent operations.

For a better understanding of the problems of and technical arrangements for the preparation of the roving and its spinning the conventional arrangement of one spinning station of a ring spinning machine will be briefly described in outline with reference to FIG. 1, bearing in mind that each spinning machine has a plurality of spinning stations across a spinning front. Each spinning front is constituted by hundreds of such stations which are driven in common, each receiving their services from motors which drive longitudinal axles and by delivery units which distribute their services along the machine.

The roving 1 comes from a device just above the spinning station which is not indicated in the drawing for simplicity, and is first introduced to the drafting unit 2. This generally consists of members for drafting the roving at linearly increasing speeds which gradually reduce it by making the fibres of which it is composed slide over one another. In FIG. 1 the drafting unit is driven via a pair of belts 3 and 4 of which the underlying belt 3 is driven to move by a knurled segment 5 of a longitudinal bar 6 in common with the adjacent spinning stations and rotating in direction of the arrow a.

The path of the lower belt 3 is approximately triangular, and determined by a common terminal bar 7 which extends longitudinally. The overlying belt 4 is freely movable and is driven to move in the direction of the arrow b by the underlying belt 3 onto which it is pressed by an overlying support in common with an adjacent spinning station. The path of the upper belt 4 is also approximately triangular and determined by a roller 8 and a fixed terminal bar 9.

Downstream of the belts 3 and 4 is located a pair of drafting rollers 11, 12 which impart the final draft to the roving, being provided with a linear speed greater than that of the preceding belts 3, 4. The lower roller is constituted by a grooved segment 13 of a longitudinal bar 11, common with the adjacent spinning stations and rotating in the direction of the arrow c. The upper counter roller 12 is idle and is also pressed by the common overlying support against the roller segment which drives it to rotate in the direction of the arrow d with the refined roving from which the yarn 20 is formed interposed between them.

The yarn 20 first passes the fixed yarn guide 21, typically in the form of a pigtail and from there to the rotating ring 22 which rotates on a fixed ring 23 carried by a common ring rail 24 continually driven in direction of the arrow e in two directional senses continually to cause the rings 23 to rise and fall and to distribute the winding of the thread into a spool 25 on the bobbin 26. The bobbin 26 is fitted on the underlying rotating spindle driven to rotate at high speeds which currently are in the region of 10,000–20,000 revolutions per minute.

Upon each rotation of the spindle, or rather of the spool 25, it pulls the yarn released from the drafting unit and winds it onto itself and generates substantially one revolution of twist of the yarn 20, which draws the small rotating ring 22 into rotation with a slight delay due to its friction with the guide ring 23. If the spindle rotates R revolutions per minute and cylinders 11, 12 release S meters of drafted roving 20 the twist T applied to one meter of yarn produced is equal to R/S.

The yarn 20 rotates in a vortex about the spool forming the so called 'balloon' by the effect of the centrifugal force. The balloon is the cause of further stress on the yarn and can be limited with a containment ring 28. The twist in the yarn is caused by the rotation of the spool 25 and propagates, together with the stresses up to the point at which the yarn 20 is released from the last of the drafting cylinders 11, 12.

The point of release from the cylinders is the point of least strength of the yarn; the roving which begins to receive twist and tension is still in the state of parallel distributed fibres spaced along a web of a certain width. The relative weakness of the roving at the output of the drafting device constitutes a factor limiting the productivity of spinning machines.

SUMMARY OF THE INVENTION

The object of the present invention is to improve the quality of the drafted roving released from the drafting unit, which provides both a process and a drafting device of new concept, which gives the twisting unit of the spinning machine a cleaner and stronger ready-compacted roving.

The drafting device and the associated roving drafting process of the present invention make it possible to improve the mechanical quality of the roving and the yarn produced and also have positive effects on the productivity of the spinning machine.

BRIEF DESCRIPTION OF THE DRAWINGS

The invention will hereinafter be described with reference to various embodiments illustrated in FIGS. 2–12 by way of exemplary but non-limitative example, and for the purpose of rendering the characteristics and advantages of the present invention more evident, in which reference is made to the annexed schematic drawings, in which:

FIGS. 6, 7 and 8 show a variant of the preceding condensing unit;

FIGS. 16 to 20 show alternative elements of the tensioner for filtering elements in the form of air-permeable flexible rings.

DETAILED DESCRIPTION OF THE INVENTION

Figure 2:
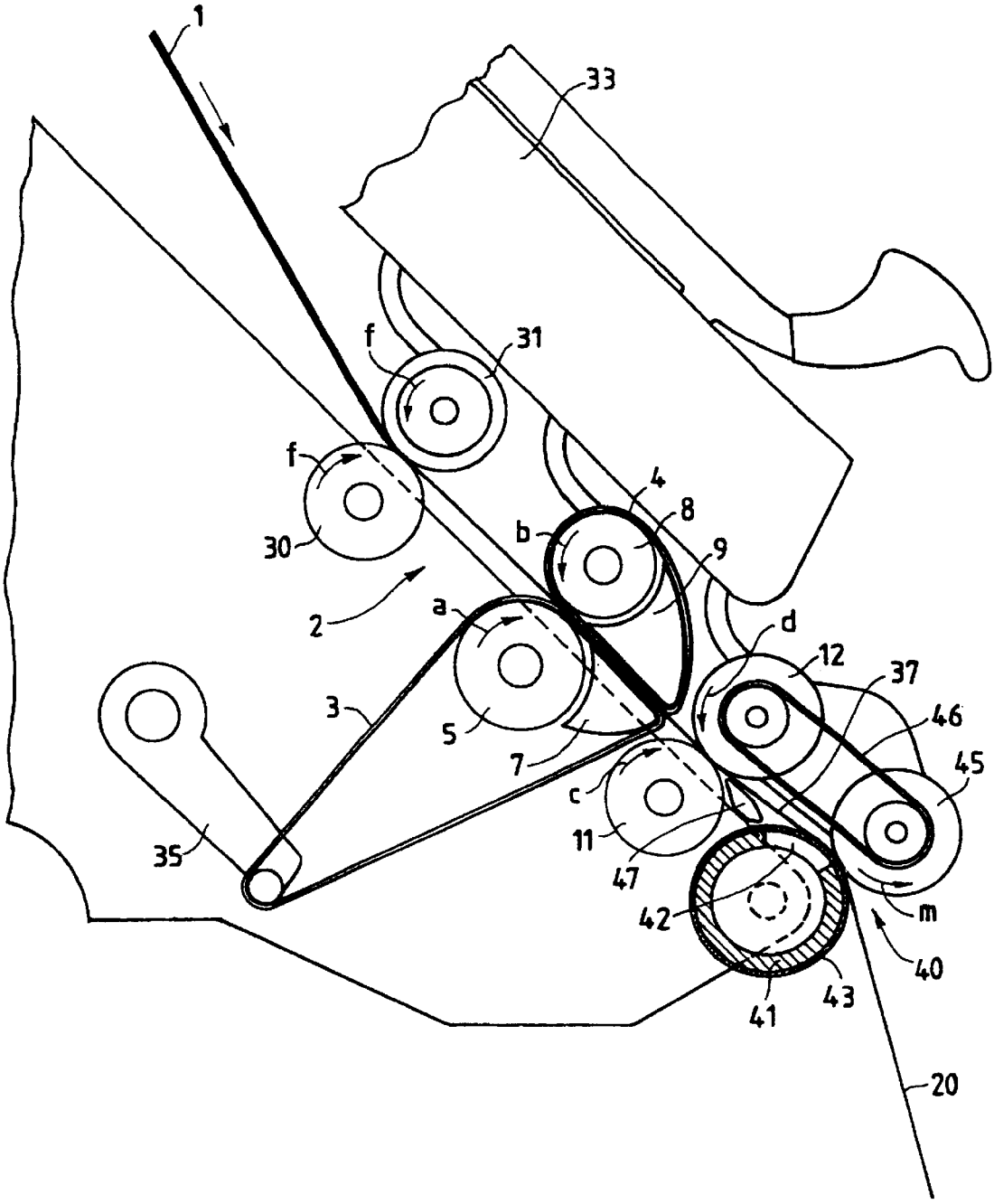
FIG. 2 is a schematic side view of the drafting and condensing device according to the invention.

With reference to FIG. 2 there is shown in side view a structure of a typical embodiment of the roving drafting and condensing unit according to the invention. The following Figures show details of different embodiments of the filtering units shown in views from above, in section and from the front of the final part for condensing of the roving.

In FIG. 2 the roving 1 still at its original dimensions, arrives from above from its formation and is pinched by a first pair of rollers 30, 31 which draft the roving at a controlled linear velocity. The lower roller or cylinder 30, like the other rollers of the drafting unit, consists of a grooved segment of a longitudinally rotating bar, in common with the adjacent spinning stations, rotating in the direction of the arrow f. The upper counter roll 31 is similarly idle and it is also pressed—by the common overlying support 33—against the roll of 30 which drives it to rotate in the direction of the arrow f', with the roving interposed between them. The support 33 also carries the other upper members of the drafting unit and presses them against the underlying members with a predetermined and regulated force.

Figure 1:
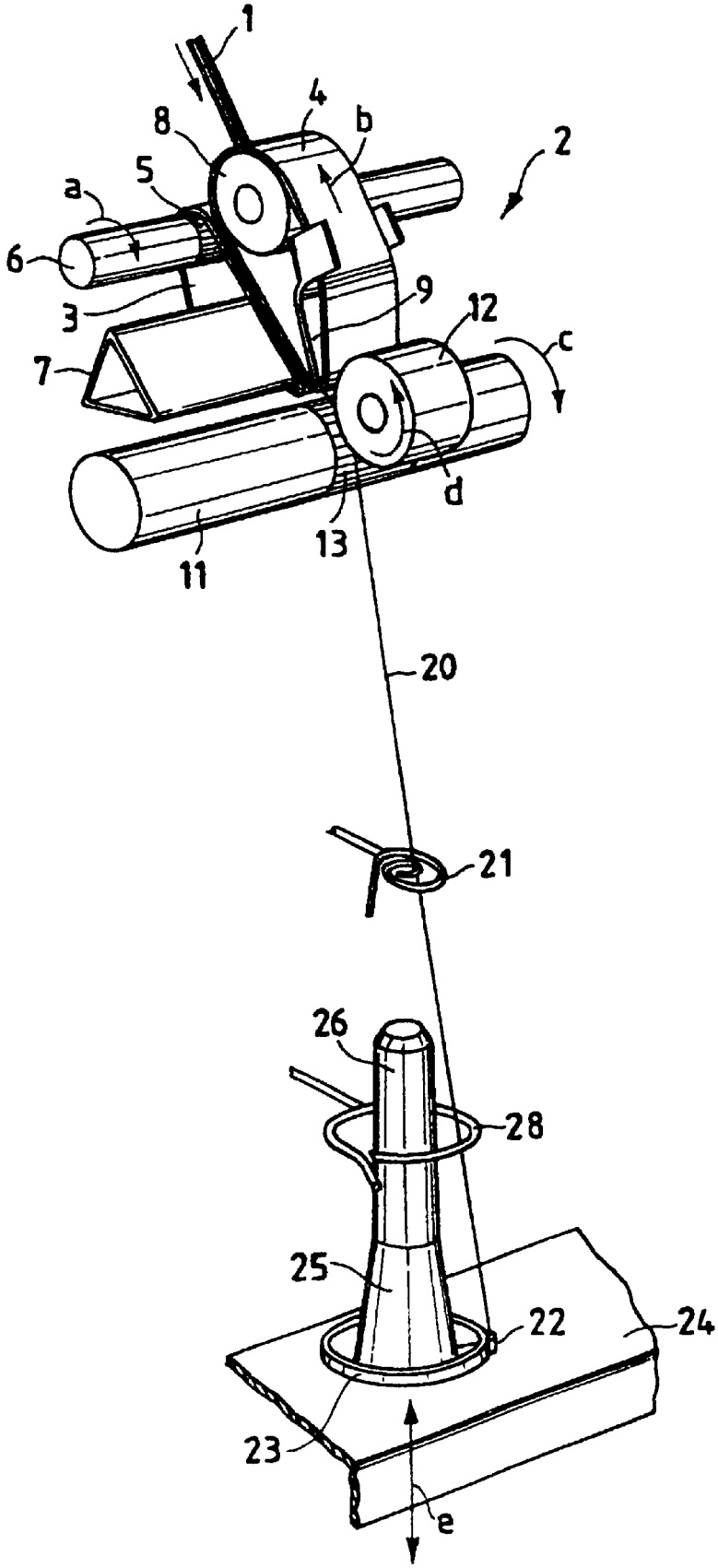
FIG. 1 is illustrates the technical problem of drafting the roving with reference to its application to a ring spinning machine of conventional type.

The second member of the drafting unit is constituted by belts 3, 4, the essential parts of which are already described with reference to FIG. 1 and are known per se. The lower belt 3 is held under tension by a lever tensioner 35.

The third drafting unit member, downstream from the belts 3 and 4, consists of a pair of draft rollers 11, 12 which impart the final draft to the roving, and correspond to those described with reference to FIG. 1 and are known per se.

The draft imparted to the roving by the series of three members described above, and are known per se, is progressive and determined by the increasing linear speeds which each of these described members impart to the roving progressively transferred to it. Each of the said members is in fact provided with drive means to give them a determined speed of rotation. Roving which leaves the pair of cylinders or rollers 11, 12 is constituted by a strip 37 of reduced dimensions with respect to the original roving 1 and travels at a higher linear speed. In general this speed, depending on the type of fibres being worked, the characteristics of the yarn to be produced and the starting roving, lies in the range from 15–35 meters per minute.

The roving 37 then passes to the condensing unit 40 which is located downstream of the drafting unit, before it is forwarded for twisting. This condensing unit 40 constitutes one of the characterising elements of the present invention.

The condensing unit 40 also consists of a pair of counterposed members which pinch and draft the roving downstream. These counterposed members have a surface with suction openings which reduce the transverse dimensions of the roving 37, and a presser roll which presses it against this surface. In the exemplary embodiment illustrated hereinbelow the suction surface is located below and the presser roll is located above; in principle the two positions can be reversed with respect to one another. In FIG. 2 the lower member is constituted by a fixed tube 41 connected to a suction source provided with suction slots 42 disposed in the path and in the direction of movement of the roving 37 in correspondence with each drafting unit 2 of the spinning station. On the surface of the fixed tube 41 and in correspondence with the suction slot 42 there is positioned a filtering element 43 which is interposed between the moving roving 37 and the fixed slot 42. By the effect of the suction action of the slot 42 on the fibres of the roving 37, with the interposition of the filtering surface, the transverse dimension of the web of drafted roving 37 is restricted by urging it towards the reduced width of the suction slot, that is to say substantially towards the dimensions of the yarn 20. This action draws together the fibres of the roving 37, significantly increasing the cohesion by inter fibre friction and correspondingly increasing its strength even before receiving the twist which propagates from below upwardly from the spindle to the drafting unit. As well as this effect, and still by the suction action of the lower element, the drafted roving is relieved of some of the impurities which it still contains, and the short pieces of fibre which project from it, giving a more compact and stronger resultant thread as well as a better aspect.

The upper member of the condensing unit 40 is constituted by a presser roll 45—generally formed of elastomeric material—which presses the compacted roving against the fixed tube 41 and its filtering surface 43, contacting it at a point at which the roving is already compacted and, generally, downstream of the end of its suction slot 42, still in correspondence with each drafting unit 2 of the spinning station. The pressure exerted by the roll 45 does not allow the twist which rises from the spindle to propagate substantially upstream before the roving is released from the condensing unit. The upper roller 45 is provided with rotary drive means for rotating in the direction of the arrow m and is driven to extract the roving 37 at a linear speed which in any event is not less than that of the preceding rollers 11, 12 in such a way as to ensure that the roving 37 is under tension. For example, its speed can be regulated to a higher value than that of the rollers 11, 12, preferably an increase of 1–3% to obtain a certain supplementary drafting effect. Still by way of example, as shown in FIG. 2, the press roller 45 can be driven by the preceding press roller 12, by means of a belt and pulley transmission 46 which ensures the desired linear speed ratio of the roving the passage between the roller 11, 12 and the condensing members.

In a variant embodiment of the present invention, between the final group of draft rollers 11, 12 and the condensing unit 40 there is interposed a support surface 47 to provide the correct introduction of the roving 37 to the unit 40, especially effective in transient phases.

In the following Figures there are shown several typical embodiments of such filtering elements and their arrangement with respect to the fixed tubing 41 and the drafting unit. In a preferred embodiment of the invention the member which forms the filtering surface 43 is a movable member which moves coherently with and in the same linear direction as the press roller 45. On the other hand the invention can be put into practise with a filtering surface 43 which is not necessarily movable.

Figure 3:
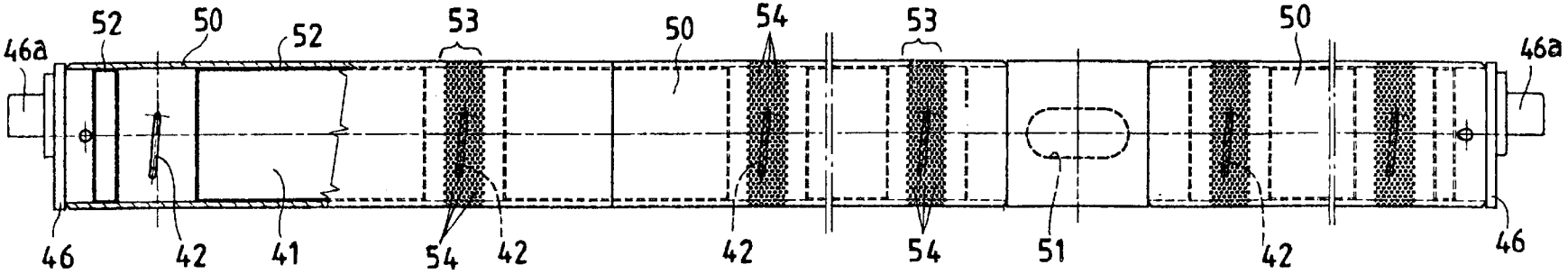
FIGS. 3, 4 and 5 show a typical embodiment of a condensing unit with a rigid filtration sleeve.
Figure 4:
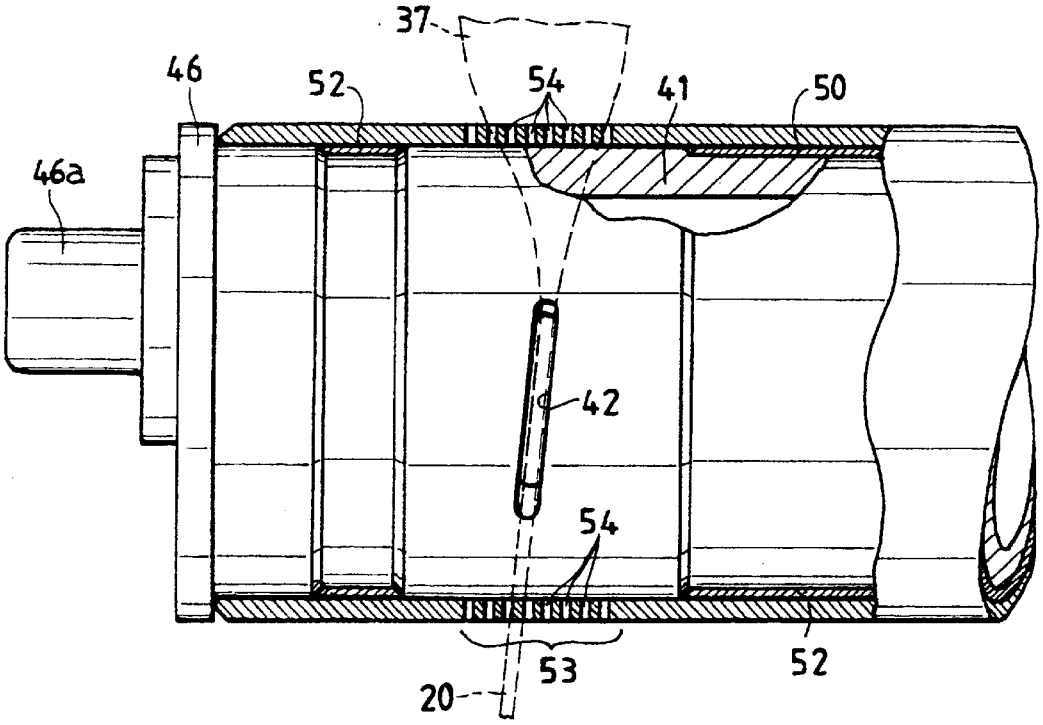
Figure 5:
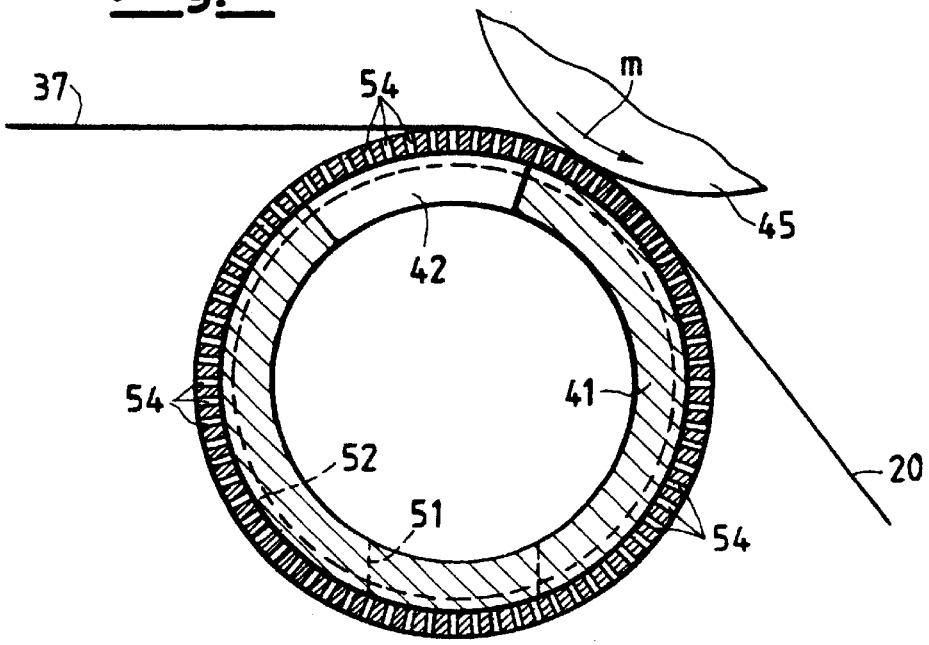

According to the exemplary embodiment shown in FIGS. 3, 4 and 5 the filtering member is constituted by a perforated cylindrical sleeve 50 which is mounted on the fixed tubing 41 and caused to rotate with respect to it by the upper roller 45. As shown in FIG. 3, which shows a sectioned view from above of a part of the tubing 41, the said fixed tubing 41 is formed with a circular cross section and in pieces or discreet sections, to serve, for example, eight spinning stations for each section and in its central part is connected with the aperture 51 to a centralised suction system with the interposition of interception members, not shown in the drawings for simplicity. In the exemplary embodiment of FIGS. 3, 4 and 5 each sleeve 50 is formed with a length corresponding to two drafting units and such as to involve two consecutive slots 42. The sleeve 50 could equally be formed with a greater length to serve a greater number of drafting unit 2, or can be made shorter, one sleeve 50 for each drafting unit 2.

As shown in greater detail in FIG. 4, which is a view from above of the end portion of tubing 41, and FIG. 5 which shows the transverse section of it, in the body of the tubing 41 there are formed suction slots 42 in the form of elongate narrow slots slightly inclined with respect to the right section of the cylinder of the tubing 41. The dimensions of the slots are, in general, in the region of between 0.5 and 5 mm in width and between 10 and 20 mm in length. Each tubing 41 is provided with closure terminals 46 and elements 46*a* for mounting each tube on the structure of the spinning machine.

In the example shown the sleeves 50 are formed of cylindrical tubular form of length sufficient to cover the slots of two groups of adjacent drafting units and with a diameter such as to be mounted with precision on the tubing 41. The outer surface of the fixed tubing 41 is worked with raised portions and cylindrical concavaties for the positioning of centering rings 52 and interposition between the fixed tubing 41 and the rotating sleeve 50.

In each band 53 of the sleeve 50 which corresponds to the slots 42, and over the whole of its circumference, there is formed a series of regularly distributed holes 54. In general the density of the holes 54 in this band 53 is 10–30 per square centimeter and with dimensions of 0.5–2 mm.

The roller 45 presses the compacted roving 20 downstream of the end of the slot 42. By way of indication in FIG. 4 there is shown, in broken outline, the path which the roving 37 follows by the effect of the suction through the slots 42 acting through the perforated band 53; the condensing effect propagates upstream in dependence on the length of the fibres of the twisted roving 37.

The rotating sleeve 50, in a preferred embodiment of the invention, can be made of a synthetic polymeric material having good mechanical and self-lubricating properties, for example a material based on polyamides, polyaldehydes and the like.

Figure 6:
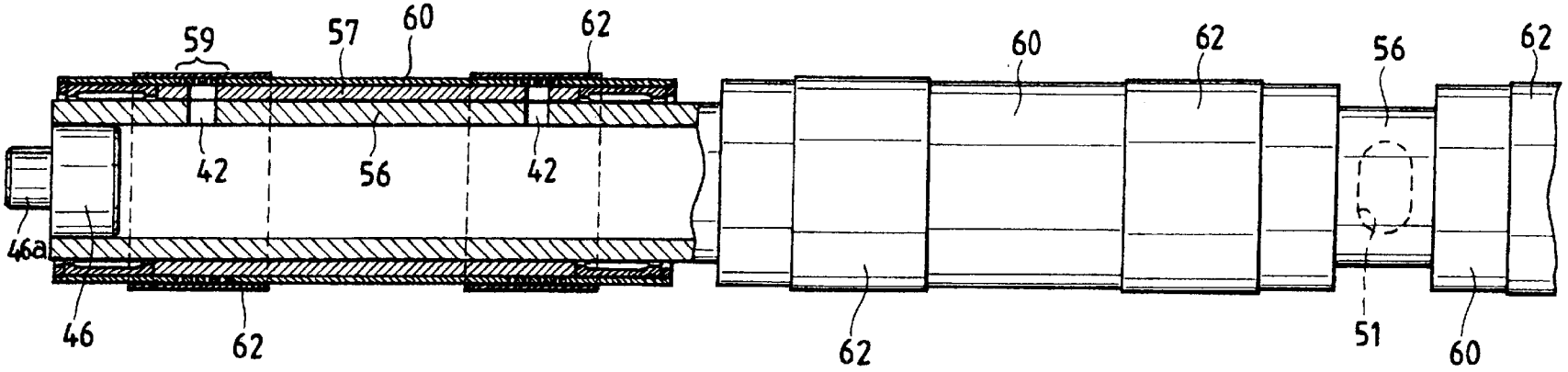

In the variant of the preceding embodiment, shown in FIGS. 6, 7 and 8, the filtering member is again constituted by a perforated cylindrical sleeve which is mounted on the fixed tubing 41, and is put into rotation with respect to it by the upper roller 45. FIGS. 6, 7 and 8 correspond respectively to FIGS. 3, 4 and 5.

In the embodiment of FIGS. 6, 7 and 8 reference is again made to a sleeve with a length which corresponds to two drafting units. In this example the structure of the fixed tubing 41 is made up of two tubular elements, 56, 57, which are coaxial and fitted onto one another, of which the outer layer 57 is made of a material and provided with a surface finish which offers less frictional resistance in relation to the sleeve 60 which rotates with respect to it. In each band 59 of the sleeve 60 which corresponds to the slots 42, and around the entirety of its circumference there is again formed a series of regularly distributed holes 61. In general these holes are larger and more widely spaced than those of the preceding embodiment in that to the perforated band 59 there is applied a layer of filtering textile 62 of suitable mesh dimensions, generally lying between 25 and 150 microns. Again by way of example, filtering layers based on synthetic technical fabrics of polyamide, polyacrylamide and the like are generally suitable as filtering layers. These can be fixed to the underlying sleeve 60 by the application of adhesives.

In a further variant, as an alternative to the composite filtering structure of the example of the preceding FIGS. 6 to 8, the filtering element 43 can be formed simply by a loop of textile in a layer of suitable mechanical consistency and permeability, which is applied directly onto the fixed tubular element 41 in correspondence with the slot 42, without the interposition of a rigid perforated sleeve 60. In this case the fixed tubing 41 can be formed with a circular section on with sections of different form, and preferably with suitable rounding.

Figure 9:
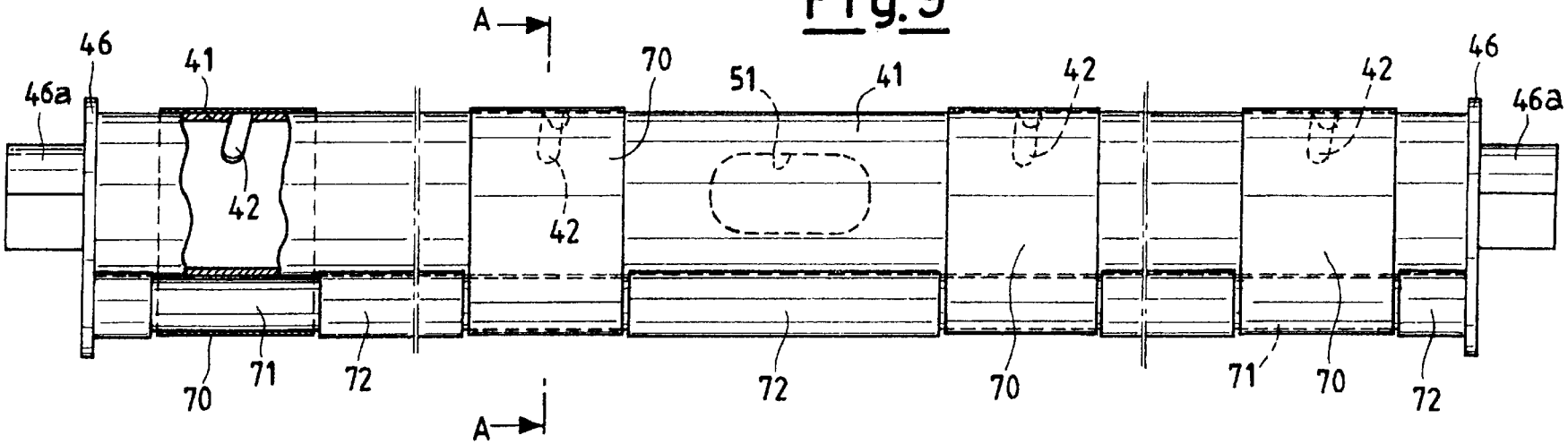
FIGS. 9 and 10 show a typical embodiment of a condensing unit with a flexible filtering element.
Figure 10:
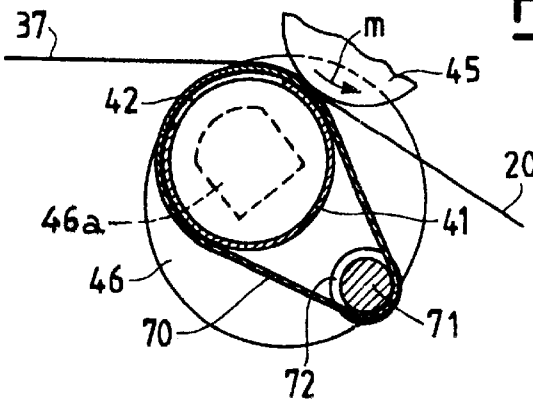

An example of this further alternative embodiment is shown in FIGS. 9 and 10—in which FIG. 9 shows a view from above of the piece of tubing 41 partially sectioned and FIG. 10 shows its section taken on the line A—A.

The filtering element 43 is constituted by rings 70 of permeable fabric of suitable mechanical and filtering characteristics, of the type already previously indicated. Each loop 70 is individually associated with a drafting unit 2 and covers the corresponding slot 42 of the fixed tubing 41 with a large margin and is driven by the upper roller 45. The path of the loop 70 is determined by the outer surface of the tubing 41 and by a return bar 71 fixed onto the ends 46 of the piece of tubing 41. On the bar 71 are formed guide recesses for maintaining the loop 70 in their correct axial position, alternating with spacer enlargements 72. The relative position of the bar 71 with respect to the fixed tubing 41 can be modified to maintain the desired tension of the filtering loops 70 by further inserting resilient tensioners, not shown in drawings for simplicity. In general the width of the recesses of the bar 71 and of the filtering loop 70 is in the region of between 12 and 30 mm.

A further structural variant of the present invention, in which the filtering element 43 consists of a movable loop of flexible textile layer without the interposition of the rigid sleeve 60, is illustrated with reference to FIGS. 11A, B and 12A, B, C in which FIGS. 11A, B show a side view in section of the final part of the drafting unit and condensing unit and FIGS. 12A, B, C show a schematic perspective view of only the condensing unit limited to one piece of tubing 41 and its assembly details.

In this second further variant as well each filtering loop 90 is related individually to a drafting unit 2 and covers the corresponding slot 42 of the fixed tubing 41 with a large margin and is driven to circulate by its upper roller 45. In the variant of FIGS. 11A, B and 12A, B, C the path of the loops 90 is determined by the outer surface of the tubing 41 and by an individual return bar 91 for each filtering loop 90. The bars 91 are individually supported or collectively supported again on the pieces of tubing 41.

Figure 11A:
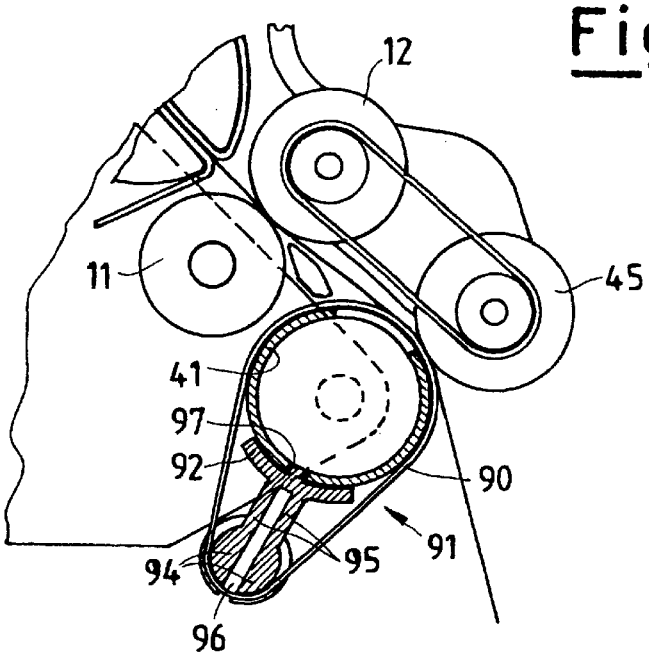
FIGS. 11A, B and 12A, B, C show a variant of the condensing unit of FIGS. 9 and 10, with individual filtering element tensioners.

As shown in the sectional view of FIGS. 11A, B—which differ by the manner of attachment between the bars 91 and the fixed tubing 41—the return bar 91 comprises a concave part 92 for fixing to the fixed tubing 41 to lie alongside and be fixed to the body of this tubing. In the details of FIGS. 12B, C are shown two possible alternatives of this fixing. At the opposite end the return part of the loop is conformed to two rounded, preferably semi-cylindrical, ends 94 carried by two relatively slender prongs 95 separated from one another by a space 96. The body of the return bar 91 is made of material having good elastic characteristics in such a way that the insertion and removal of the filtering loop 90 can be easily achieved by the operator simply compressing the two prongs 95 and restricting the space 96 and then inserting or removing the filtering loop. When this operation has been performed the prongs 95 are released: they diverge elastically from one another and tension the loop 90 itself to the desired amount. In the space 96 it is possible to insert elastic elements, for example leaf springs, to increase the separating force of the prongs 95 and the tension of the filtering loops 90. On its inner face the concave part 92 carries a centering pin 97 for locating on the tubing 41.

Figure 12A:
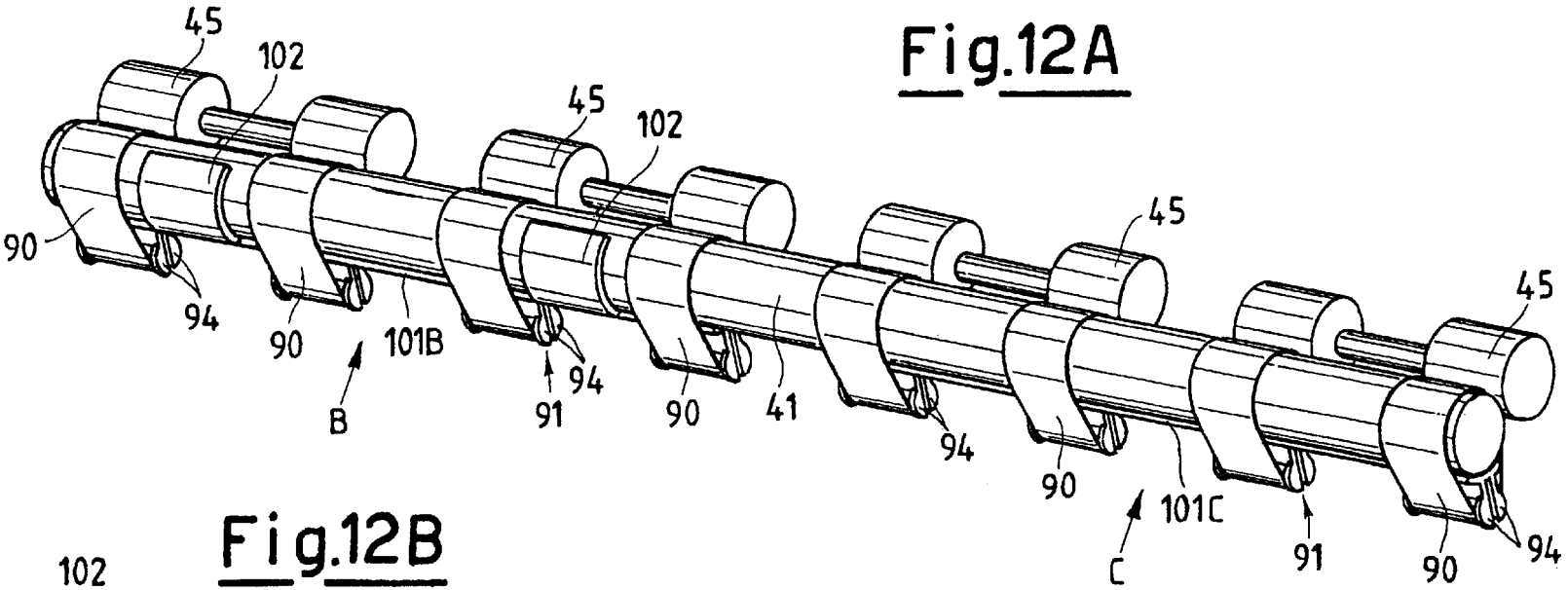
Figure 12B:
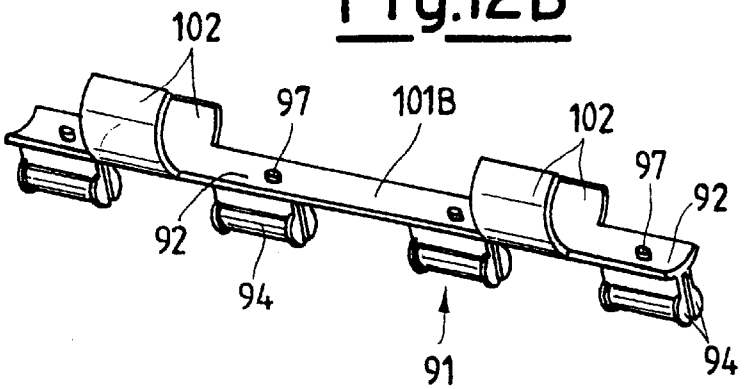

By way of example FIG. 12A shows a perspective view of the fixed pieces of suction tubing 41 which serves eight spinning stations, in which are shown two ways of attachment of the individual return bars 91 to this tubing, subdivided into two groups of four. The two kinds of attachment are shown also in the two section details of FIGS. 11A, B. As illustrated for the left hand four spinning stations indicated with the arrow B, four cone shaped return bars 91 are joined on a common concave sliding support 101B—which extends between the parts 92 of each bar 91—of concavity matching that of the outer surface of the tubing 41 on which they are fixed by means of a plurality of resilient jaws 102 which are forced to enter into engagement with the tubing 41 thereby maintaining the bars 91 in the desired position. The correct mutual positioning is established by the coupling of the pins 97 into cavities provided on the tubing 41.

Figure 11B:
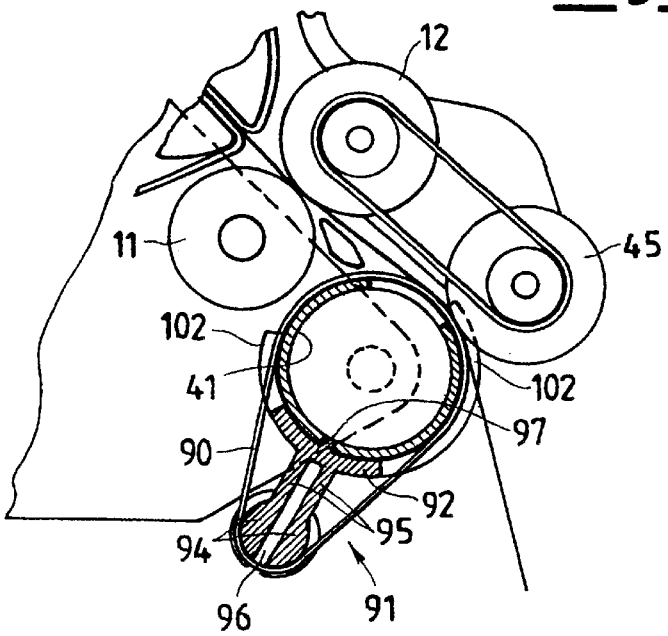
Figure 12C:
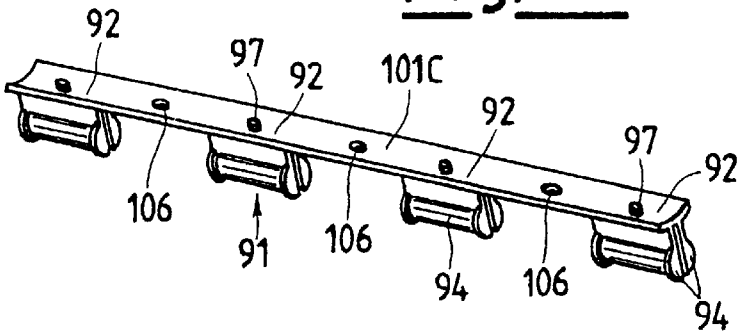
Figure 13:
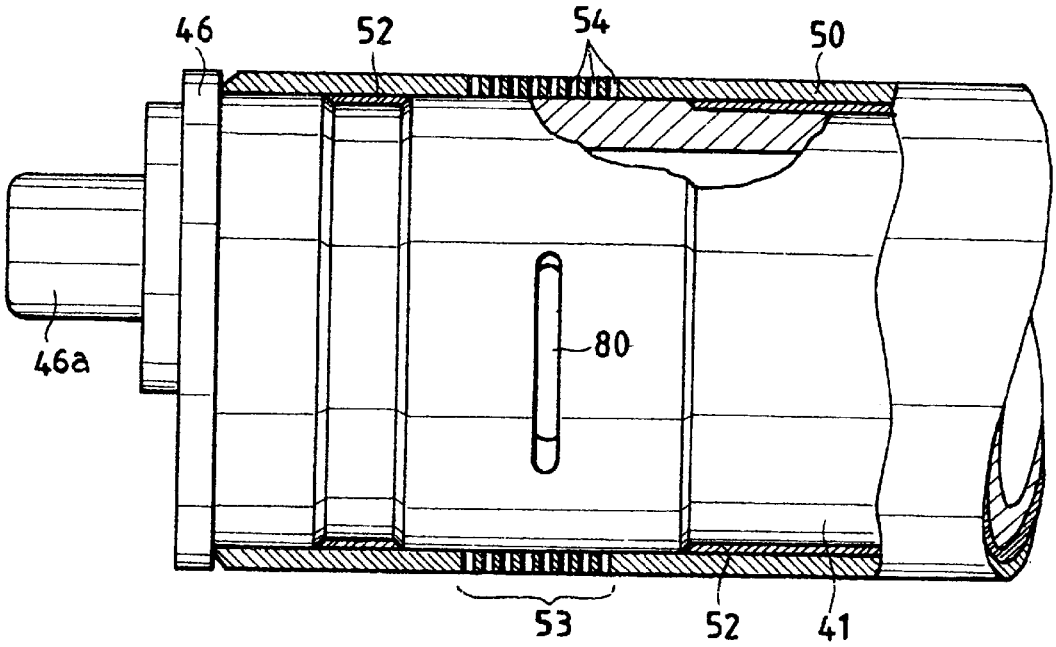
FIGS. 13 and 14 show a variant of the form of the suction opening.
Figure 14:
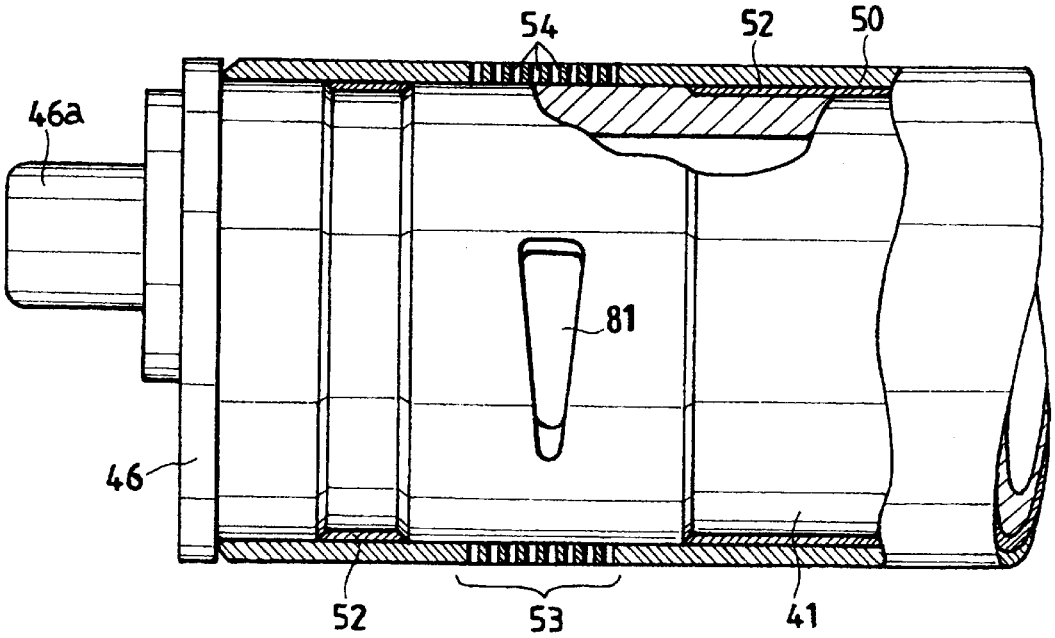

In the manner illustrated for the four spinning stations on the right, indicated with the arrow C, four return bars 91 are joined on a common concave sliding support 101C which extends between the parts 92 of each bar 91, of concavity matching the outer surface of the tubing 41, on which a plurality of pins 97 and cavities similar to the preceding are positioned. The fixing between the support 101C and tubing 41 can take place by means of screws passing through openings 106 in the support to engage corresponding threaded holes in the tubing 41, or with other conventional removable connection means. In the preceding description reference is again made to the openings 42 in the form of slightly inclined slots with respect to the transverse right section of the fixed tubing 41. In FIGS. 13 and 14 there are shown—and referred to the enlarged view of FIG. 4—other forms of possible embodiments of the elongate slot 42 in the shape of the straight slot 80 in FIG. 11 and in the shape of an elongate triangle 81 in FIG. 12. The choice of the extension and shape of the slots 42 is generally influenced by the drafting and condensing operations, the roving which it is intended to work as well as the flow rate and the suction available.

Figure 15:
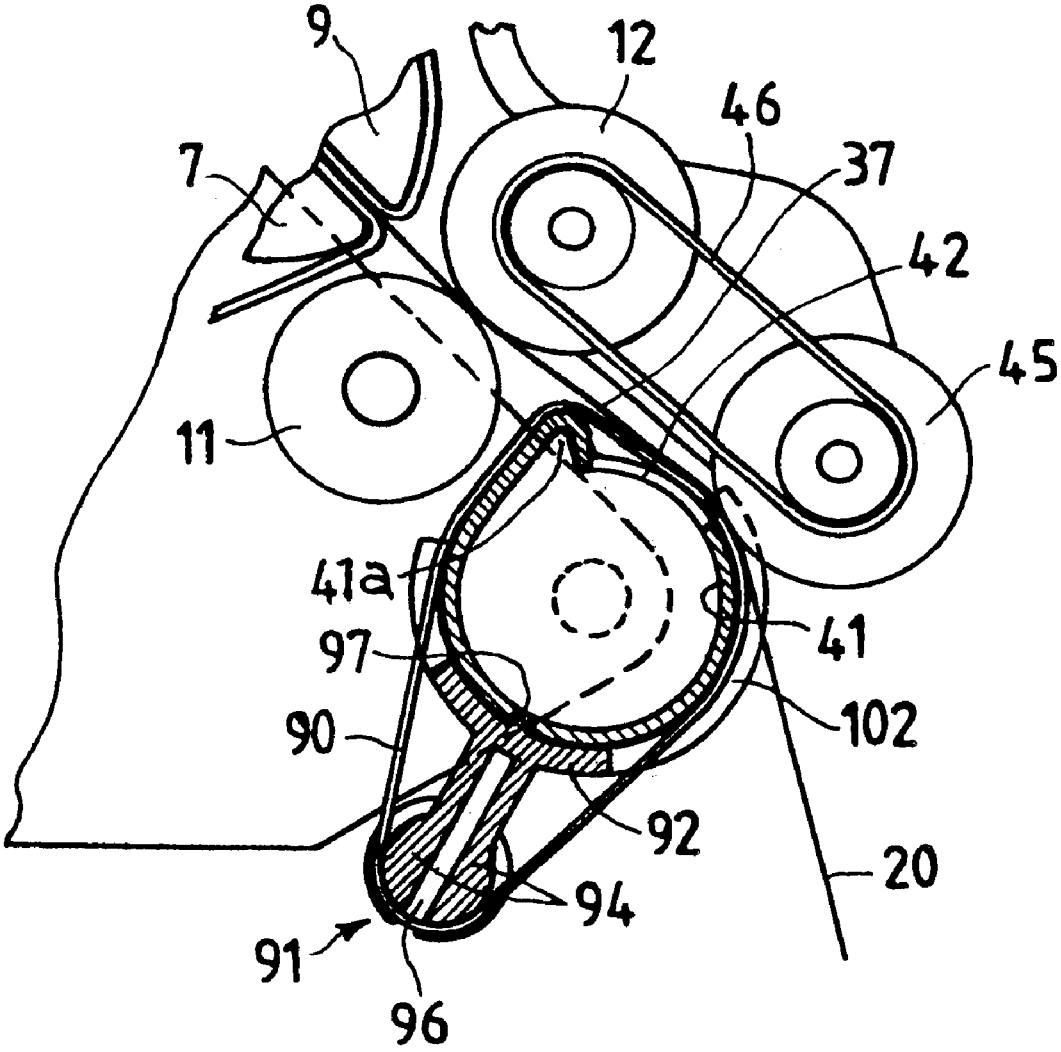
FIG. 15 shows an alternative embodiment of a tube with which the device of the present invention is provided.

A further variant embodiment of the present invention, in which the filtering element 43 again consists of a movable fabric layer loop, but with a non-circular configuration is illustrated with reference to FIG. 15.

In this further variant embodiment of the present invention account is taken of the fact that the roving 37, in the interval between the rollers 11, 12 of the final drafting unit and the condensing unit 40 tends to assume a non-rectilinear, but rather relaxed, catenary shape, partly due to the effect of the suction. Due to this phenomenon the section of tubing 41 is provided with a 'nose' or protuberance 41*a* which extends towards the final rollers 11, 12 of the drafting unit to limit the relaxation section of the roving 37 and improve its control and support. It also provides the correct entrance for the roving 37 into the unit 40, especially effective in the transient phases.

In FIGS. 16 and 17 there is shown a variant embodiment for tensioning the filtering element 90, in which FIG. 16 shows the whole element assembled and FIG. 17 shows only the return element. In this variant the return bar 91 again comprises a concave part 92 for attachment to the fixed tubing 41, to be placed alongside and fixed to the body of this tubing, having locating pins 97 like the previously-described embodiment.

At the opposite end the return part of the filtering loop 90 passes around a closed circular cylindrical body 110 which, at its ends and to maintain its filtering textile loop 90 in the correct axial position during movement, carries enlargements 111 spaced from one another depending on the width of the filtering loop 90.

The connection between the support part 92 and the body 110 is formed by a thin offset prong 112 also made of material having good elastic characteristics in such a way that the insertion and removal of the filtering loop 90 can easily be effected by the operator simply by bending the prong 112 to reduce the distance between the support 92 and the return bar 110.

Figure 18:
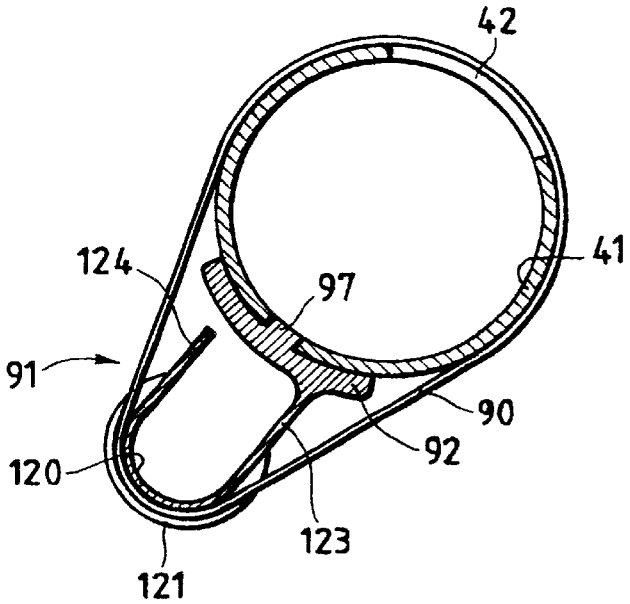
Figure 19:
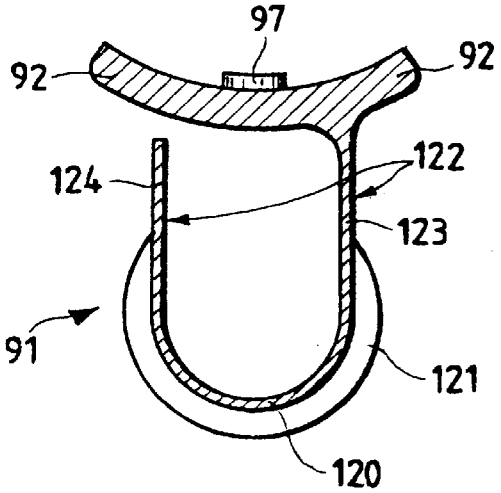

In FIGS. 18 and 19 there is shown a further variant embodiment for tensioning the filtering element 90, in which FIG. 18 shows the whole element assembled and FIG. 19 shows only the return element. In this variant the return bar 91 again comprises a concave part 92 for attachment to the fixed tubing 41 to be placed alongside and fixed to the body of this tubing like the preceding embodiments. At the opposite end the return part of the loop passes over an elliptical open body 120, also provided with terminal enlargements 121 for positioning the movable filtering loop 90 which, in motion, passes over the body 120.

The connection between the support part 92 and the elliptical body 120 is formed by a J-section element 122 which is also thin and made of a material having good elastic characteristics. Only one of the prongs 123 of the J-shape profile 122 is connected to the element 92, whilst the other prong 124 remains free to move when the body 120 is caused to move towards the element 92 by flexing the connection prong 12 to insert or remove the filtering loop 90.

In a preferred manner of producing the described return bars 91 with individual tensioners for the filtering loops 90, they are produced in profiled pieces by extrusion of material having good elastic characteristics, for example, acetyl resin, for example, DERLIN® or light aluminium based alloys, and then cut to the desired length of the bar 91.

Figure 20:
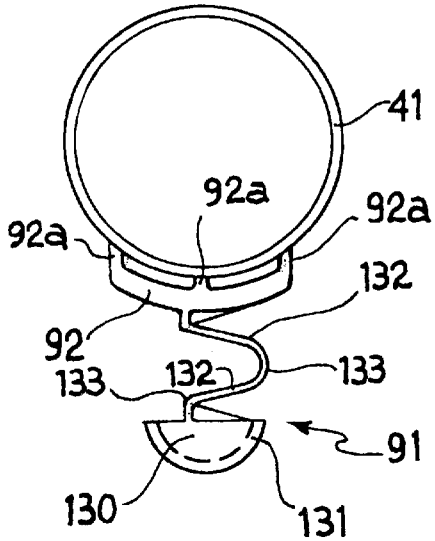

Another different variant for tensioning the filtering element 90 is illustrated in FIG. 20. From the support base 92 extends three support feet 92*a* in contact with three separate generatraces of the tubing 41 to improve the stability of the return bar 91 which rests on and is fixed to the body of this tubing like the preceding embodiments. At the opposite end the return part of the filtering loop passes over a semi-cylindrical body 130 having terminal enlargements 131 for positioning the movable filtering loop 90, which, in movement, passes over the body 130. The elastic connection between the support base 92 and the body 130 is achieved by means of two or more segments 132 joined together and to the base 92 and to the body 130 by means of flexible hinge zones 133 which render the return bar 91 elastically compressible in a direction perpendicular to the tubing 41. This configuration, as well as conferring on the bar 91 the necessary elastic properties to maintain the filtering loop under tension during operation, makes the operation of fitting and removing the filtering loop particularly simple and easy; the operator just has to compress the body 130 towards the tubing 41 with one hand whilst with the other hand can fit the filtering loop on or remove it.

The roving drafting and condensing process is evident from the description of the device described hereinbefore. At the end of the preliminary conventional drafting operation conducted between the initial rollers 30, 31, the belts 3, 4 and the final rollers 11, 12 in which the roving 1 is elongated and drafted into the silver 37, this silver is supplied to the condensing unit 40 in which is it maintained under tension and made to pass over an interior surface through which is exerted a suction action by the elongate slot 42, through a filtering surface 45. The movement of the roving 37 is ensured by the rotation of the upper roll 43 at a linear speed not less than that of the last rollers 11, 12.

In a preferred embodiment of the invention the filtering surface is preferably moved coherently with the roller 45.

The operative conditions of the condensing are generally as follows. The depression within the tubing 41 is in the range 200–600 mm water column, and preferably between 350 and 500. The draft ratio between roving 1 and yarn leaving the condensing unit 40 varies between 10 and 100. The linear output speed from the condensing unit varies between 5 and 40 meters per minute.

The drafting and condensing process performed on the roving with the device described hereinabove is very convenient in relation to drafting processes available in the prior art and the following advantages merit a mention.

The condensing operation considerably reduces the distance between the fibres of which the roving 37 is composed, significantly increasing the cohesion between them and increasing the strength of the compacted roving before receiving the twist to form the yarn itself. The resultant roving has, more over, a smaller content of impurities and short fibres.

From the drafting and condensing unit there is obtained a significantly smoother, more compact and stronger roving with a greater content of long fibres. Consequently, the roving causes less friction on the rings of the spinning machine and has a greater mechanical strength.

For the same twist, or more precisely the number of twists per meter upon spinning, the final yarn is also more compact and stronger. This increase in strength can be up to 20–25 %. If a greater yarn strength is not required the productivity of the spinning machine expressed in meters of yarn per unit of time, can be correspondingly increased as an alternative by maintaining the spindles at the same speed of rotation and increasing the rate of flow of the roving 1 advanced to the drafting unit for the same draft imparted thereto.

Because of the greater mechanical strength of the compacted roving the spindles of the spinning machine can be driven at a greater speed, it being less limited by 'ballooning' of the yarn in rotation between the rotating ring 22 and the upper yarn guide 21.

What is claimed is:

1. A device for drafting and condensing a roving of textile fibers before its transformation into yarn comprising a first drafting unit comprised of a pair of rollers, a second drafting unit comprised of a second pair of rollers and opposed belts and a third drafting unit comprising a pair of rollers, drive means for driving said rollers of each pair at a speed of rotation which provides a progressive and predetermined draft to the roving, and a condensing unit positioned downstream of the third drafting unit for condensing the roving before it is delivered to a twisting apparatus, said condensing unit comprising a pair of facing member which nip and draft the roving, wherein the lower member is comprised of a fixed tubing connected to a suction source and provided with a suction opening disposed along a path of movement of the drafted roving, a filtering element disposed on the surface of the fixed tubing in correspondence with the suction opening a pressure roller disposed in engagement with the filtering element for moving the filtering member in the direction of the drafted roving between the presser roller and the filtering element and means for rotating the presser roller to extract the roving from the condensing unit, wherein a support surface is disposed between the third drafting unit and the condensing unit for supporting the drafted roving prior to the condensing unit.

2. The device as set forth in claim 1, wherein the filtering element is comprised of a perforated cylindrical sleeve which is mounted on the fixed tubing for rotation relative to the fixed tubing by the presser roller.

3. A device as set forth in claim 1, wherein the fixed tubing is provided with a protuberance which extends toward the third drafting unit for supporting the roving to limit non-linear movement of the roving between the third drafting unit and the condensing unit.

* * * * *